US005713077A

United States Patent [19]

Humbrecht

[11] Patent Number: 5,713,077

[45] Date of Patent: Feb. 3, 1998

[54] PULL DOWN SKI MASK

[76] Inventor: Phyllis A. Humbrecht, 301 Audubon Trail, Fort Wayne, Ind. 46825

[21] Appl. No.: 679,999

[22] Filed: Jul. 15, 1996

[51] Int. Cl.[6] ..... A42B 1/00; A42B 1/18; A42B 1/24

[52] U.S. Cl. ..... 2/173; 2/84; 2/108; 2/202; 2/206; 2/181.4; 2/207

[58] Field of Search ..... 2/202, 203, 204, 2/207, 94, 108, 209.13, 172, 175.6, 181.4, 182.2, 84, 85, 86, 87, 88, 69, 69.5

[56] References Cited

U.S. PATENT DOCUMENTS

| | | | |
|---|---|---|---|
| 1,292,351 | 1/1919 | Milkes | 2/84 |
| 1,309,042 | 7/1919 | Milkes | 2/84 |
| 2,150,171 | 3/1939 | Kolly | 2/84 |
| 2,344,811 | 3/1944 | Gill | 2/173 |
| 2,462,258 | 2/1949 | Dannenberg | 2/173 |
| 2,500,982 | 3/1950 | Fligel | 2/84 |
| 3,561,010 | 2/1971 | Little | 2/173 |
| 4,347,629 | 9/1982 | Itoi | 2/108 |
| 4,404,689 | 9/1983 | DeWan | 2/94 |
| 4,422,184 | 12/1983 | Myers | 2/84 |
| 4,771,479 | 9/1988 | Silver | 2/207 |
| 5,035,004 | 7/1991 | Koester | 2/173 |
| 5,473,778 | 12/1995 | Bell | 2/209.13 |
| 5,542,127 | 8/1996 | Bezanis | 2/207 |
| 5,546,604 | 8/1996 | Geller | 2/173 |
| 5,548,847 | 8/1996 | Spicijaric | 2/209.13 |
| 5,551,087 | 9/1996 | Blutstein et al. | 2/173 |

OTHER PUBLICATIONS

Gershman, Maurice, "Self Adhering Nylong Tapes." The J.A.M. A., vol. 168, No. 7, p. 930, Oct. 1958.

*Primary Examiner*—Jeanette E. Chapman
*Attorney, Agent, or Firm*—Roger M. Rickert

[57] ABSTRACT

The disclosure relates to a coat with an integral hood wherein the front portion of the hood contains a rolled-up face mask integral with the hood. In a preferred form, the hood has an interior pocket which stores the face mask when not in use. The face mask has an upper edge sewn to the hood interior and a lower edge having VELCRO strips which cooperate with mating velcro strips in the lower interior of the hood to hold the mask in a lowered position covering the wearer's face.

5 Claims, 2 Drawing Sheets

PULL DOWN SKI MASK

SUMMARY OF THE INVENTION

The present invention relates generally to wearing apparel and more particularly to cold weather coats, jackets, sweat shirts and similar upper outerwear of the type having integral or removable head coverings or "hoods." "Hooded" sweat shirts and jackets are commonplace and generally comprise a "hat" or head covering portion extending downwardly around the back and sides of the wearer's head with the lower periphery thereof connected to the collar region of the garment. The hood may be permanently sewn to and form a part of the garment, or may be removably fasten thereto by a zipper, buttons, VELCRO or by a similar fastening technique. Such hoods leave the wearer's face unprotected from wind, rain and cold.

Winter coats with an integral hood which rolls up and may be stowed in the collar of the coat are also known. Such a coat simply has a slightly fatter than usual collar. Internal pockets for storage of items in quite different arts are also known. For example, the Wood et al U.S. Pat. No. 5,127,107 is directed to doll costumes and shows a doll's mask concealed in a pocket 42.

There have been numerous other attempts to incorporate various hats, ski masks, and other head protecting garments into coats and jackets. For example, the Buenos et al U.S. Pat. No. 4,944,041 shows a sweater with a pocket structure enclosing a ski mask, see FIGS. 22–24. Nevins U.S. Pat. No. 5,251,386 teaches a face shield as part of a hood. Shotland U.S. Pat. No. 958,977 shows a face mask which folds into a coat collar. Vagas U.S. Pat. No. 1,077,177 teaches a 2-part hood/facemask with one part secured to the collar and another part secured to the lapel of a coat. Cabelinsky U.S. Pat. No. 1,097,530 discloses a coat with an integral hood 20 and fold down face mask 29. The roll-down collar 12 forms a lower part of the face mask.

Except for the coat collar storage of a hood, none of these attempts have met with commercial success. The unsuccessful garments are either too inconvenient to use, too complex and expensive to manufacture, or have other undesirable features which render them unsuccessful.

Among the several objects of the present invention may be noted the provision of a protective face mask integral with other wearing apparel; the provision of a combined head covering hood and face covering protective mask; and the provision of cold weather wearing apparel which overcomes the drawbacks of the abovenoted prior art. These as well as other objects and advantageous features of the present invention will be in part apparent and in part pointed out hereinafter.

In general, a protective head and face covering is combined with otherwise conventional outerware such as a jacket or coat. The outerware has an upper collar region to which a hood is fastened. The hood is of the type which may be readily moved up and over the top of a wearer's head for enhanced protection and pushed back off the wearer's head when its use is not desired. A protective face mask is attached to the hood and a pocket is formed in the hood to selectively receive the face mask when face mask is not in use.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
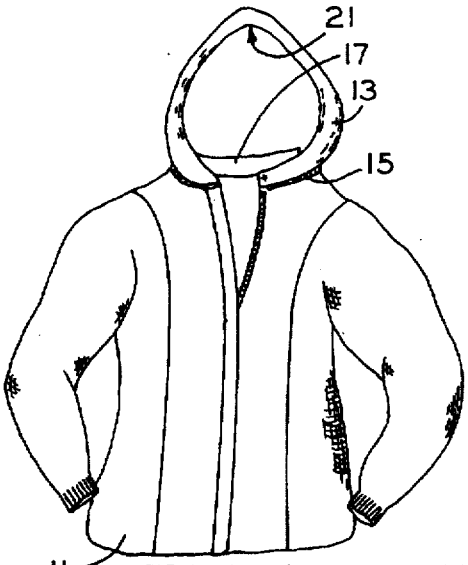
FIG. 1 is a front view of an outer garment such as a jacket having a hood attached thereto.
Figure 2:
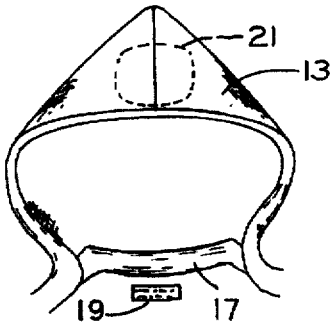
FIG. 2 is a view of the hood of FIG. 1.

FIG. 1 shows outerware such as a relatively conventional hooded jacket 11. The head protecting hood 13 is attached to the jacket by a zipper 15, however, the present invention is equally suited to a garment having an integral (nonremovable) hood. The hood is readily moved up and over the top of a wearer's head for enhanced protection and pushed back off the wearer's head when its use is not desired. A jacket collar 17 is also visible in FIG. 1. The protective head covering or hood 13 is also shown in FIG. 2 where the upper collar region of the jacket 11 has an integral collar 17 and a manufacturer's label 19. A pocket 21 contains a protective face covering which may be made of cotton ribbing, a knit material or other material commonly used in the manufacture of ski or face masks. A pocket 21 is formed inside the hood for receiving and storing the protective face mask when the mask is not in use.

Figure 3:
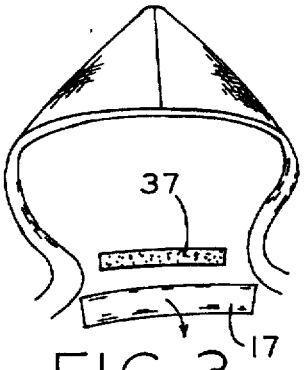
FIG. 3 is a view similar to FIG. 2, but showing the jacket collar folded down to reveal a strip of VELCRO therebehind.
Figure 6A:
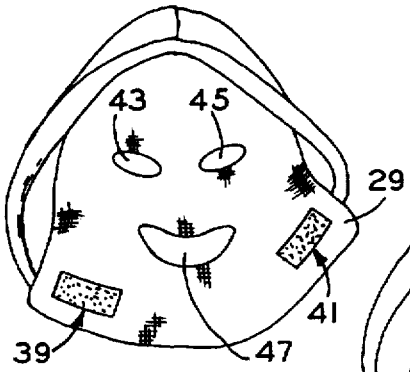
FIG. 6*a* is a view of the hood similar to FIG. 2, but with the face mask lowered.
Figure 6B:
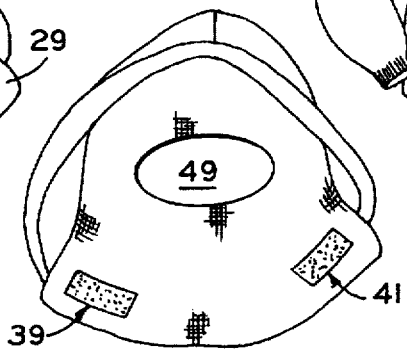
FIG. 6*b* is a view similar to FIG. 6*a*, but illustrating a variation on the face mask eye opening.

FIG. 3 is similar to FIG. 2, however, the collar 17 has been folded down to reveal a strip of VELCRO or other hook-and-tape type fastening strip 37 which is attached to the lower region of the hood interior. When the face mask is not in use, the collar 17 prevents the VELCRO strip from irritating the wearer's neck. The other component of this hook-and-tape fastening strip is attached to the face mask 29 as at 39 and 41 of FIGS. 6*a* and 6*b* and functions to hold the face mask in position during use. As seen in FIGS. 6*a* and 6*b*, the strips 39 and 41 are located near a lower edge of the mask 29 and selectively retaining the mask in a lowered position covering a wearers face.

FIGS. 6*a* and 6*b* differ only in the configuration of the eye opening. In FIG. 6*a*, the wearer is provided with separate eye openings 43 and 45, and a nose and/or mouth opening 47. In FIG. 6*b*, a single larger opening 49 is provided. With stretchable knit materials, this opening may allow the wearer binocular vision with the mask covering the wearer's nose and mouth. The mask may be stretched to expose the nose and mouth if desired. Of course, other opening configurations are possible.

Figure 4:
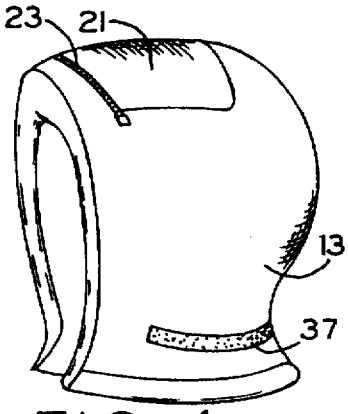
FIG. 4 is a view of the hood turned inside-out and with a portion thereof removed to reveal the pocket-closing zipper.
Figure 5:
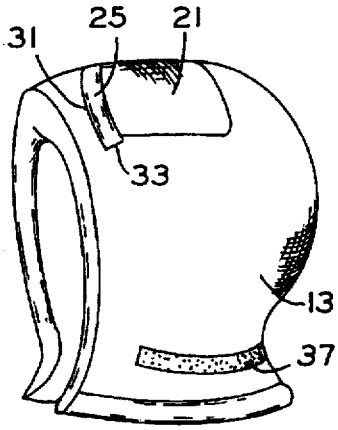
FIG. 5 is a view of the complete hood turned inside-out.
Figure 7:
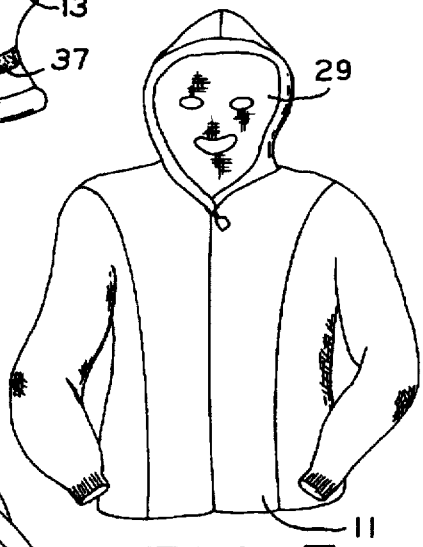
FIG. 7 is a view of the jacket and hood similar to FIG. 1, but with the face mask lowered.

In FIG. 4, the hood 13 has been turned inside-out. The pocket 21 may simply be a separate piece of fabric stitched along three of its four sides, or otherwise attached to the hood. The pocket may be closed as by a zipper 23 when the face mask is stowed therein. Comparing FIGS. 4 and 5, it will be noted a flap 25 has been added to cover the zipper 23. This flap may be sewn to the hood along three of its four edges as at 31, 33 and 35 of FIGS. 4 and 8 allowing access to the zipper along its fourth edge. In some cases, the zipper 23 may be omitted and the flap 25 itself is sufficient to secure the face mask in the pocket.

Figure 9:
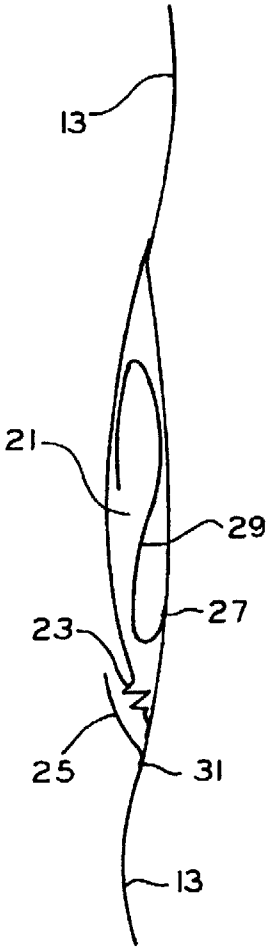
FIG. 9 is a view in cross-section along lines 9—9 of FIG. 8.
Figure 8:
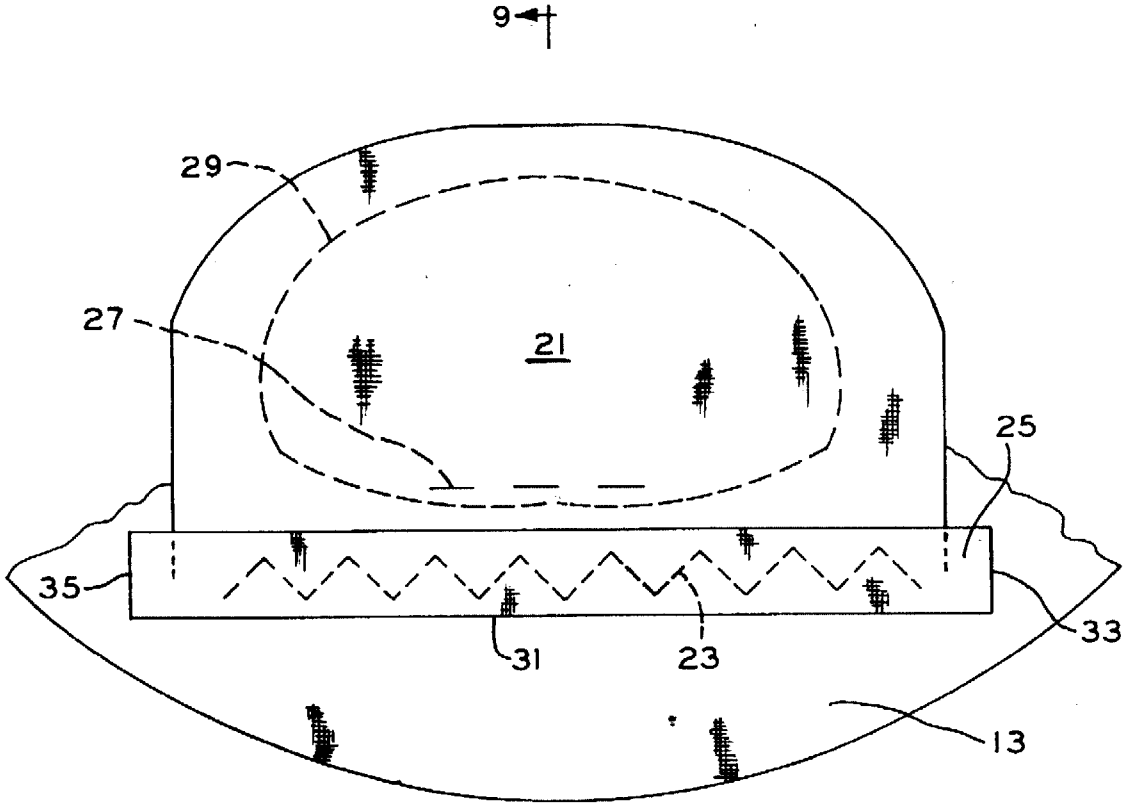
FIG. 8 is a view of a portion of the upper inner part of the hood.

FIGS. 8 and 9 illustrate the mask 29 secured in the pocket 21 with zipper 23 closed and flap 25 covering the zipper. A top edge of the protective face mask is attached to the interior of the hood pocket as by sewing at 27. For example, the center portion of flap 25 is spaced back from the hood front edge by about one inch while the edges of the flap 25 are about one-half inch from the hood front edge.

The method of use of the invention should now be clear. With hood 13 either raised or lowered, the wearer reaches beneath the flap 25 and opens zipper 23. The face mask 29 may then be partially withdrawn from the pocket 21. Note the stitching at 27 prevents the face mask from being completely removed from the pocket. With the hood raised over the wearer's head, the mask is pulled downwardly over the face and the VELCRO tabs 39 and 41 are pushed backwardly over the collar 17 and into engagement with VELCRO strip 37 securing the face mask in position.

From the foregoing, it is now apparent that a novel face protecting garment arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. In outerwear, a protective head and face covering comprising:

an upper collar region;

a hood having a lower peripheral portion thereof fastened to the upper collar region and of the type which may be readily moved up and over the top of a wearer's head and extending outwardly around the back and sides of the wearer's head for enhanced protection and pushed back off the wearer's head when its use is not desired;

a protective face mask formed of a cotton ribbing material and attached to the hood;

a pocket formed in the hood to selectively receive the face mask when face mask is not in use with a top edge of the protective face mask being attached to the interior of the hood pocket; and means for selectively closing the pocket to secure the face mask therein.

2. The protective head and face covering of claim 1 further comprising means near a lower edge of the mask for selectively retaining the mask in a lowered position covering a wearers face.

3. The protective head and face covering of claim 2 wherein the means for selectively retaining comprises one component of hook-and-tape fastening strips, the other component being attached to the hood interior near a lower edge thereof and intermediate the hood and the upper collar region whereby the upper collar region covers the other component and prevents the other component from irritating the wearer's neck when the protective face mask is not in use.

4. In outerwear, a protective head and face covering comprising:

an upper collar region;

a hood having a lower peripheral portion thereof fastened to the upper collar region and of the type which be readily moved up and over the top of a wearer's head and extending downwardly around the back and sides of the wearer's head for enhanced protection and pushed back off the wearer's head when its use is not desired;

a protective face mask formed of a knit material and attached to the hood;

a pocket formed in the hood to selectively receive the face mask when face mask is not in use with a top edge of the protective face mask being attached to the interior of the hood pocket; and means for selectively closing the pocket to secure the face mask therein.

5. The protective head and face covering of claim 4 further comprising means near a lower edge of the mask for selectively retaining the mask in a lowered position covering a wearers face, the means for selectively retaining comprising one component of hook-and-tape fastening strips, the other component being attached to the hood interior near a lower edge thereof and intermediate the hood and the upper collar region whereby the upper collar region covers the other component and prevents the other component from irritating the wearer's neck when the protective face mask is not in use.

* * * * *